United States Patent [19]

Maezawa

[11] 4,353,178

[45] Oct. 12, 1982

[54] CALENDAR DISPLAY DEVICE

[75] Inventor: Shuji Maezawa, Suwa, Japan

[73] Assignee: Kabushiki Kaisha Suwa Seikosha, Tokyo, Japan

[21] Appl. No.: 121,068

[22] Filed: Feb. 13, 1980

[51] Int. Cl.[3] ..... G09D 3/00; G04B 19/24

[52] U.S. Cl. ..... 40/107; 368/30

[58] Field of Search ..... 368/28, 29, 30; 40/107, 40/448, 450, 451; 364/705

[56] References Cited

U.S. PATENT DOCUMENTS

| | | | |
|---|---|---|---|
| 3,738,099 | 6/1973 | Tanaka | 368/30 |
| 4,152,768 | 5/1979 | Kuriya | 36 4/705 |
| 4,205,516 | 6/1980 | Terao | 368/29 |
| 4,233,681 | 11/1980 | Murata | 368/29 |
| 4,233,681 | 11/1980 | Murata | 368/30 |

FOREIGN PATENT DOCUMENTS

| | | | |
|---|---|---|---|
| 54-111864 | 9/1979 | Japan | 368/30 |

*Primary Examiner*—Gene Mancene
*Assistant Examiner*—Michael J. Foycik
*Attorney, Agent, or Firm*—Blum, Kaplan, Friedman, Silberman and Beran

[57] ABSTRACT

A liquid crystal calendar display device presents a full month of dates in a large-sized format. Sunday is always located in the left column or in the alternative in the right column of the calendar display regardless of the day which is the first date in the presented month. Only 16 electrode patterns are used to form all dates, and months of twenty-eight to thirty-one days are accommodated. Display elements are driven by a V-2V AC amplitude selective multiplexed system.

20 Claims, 14 Drawing Figures

FIG. 1 (PRIOR ART)
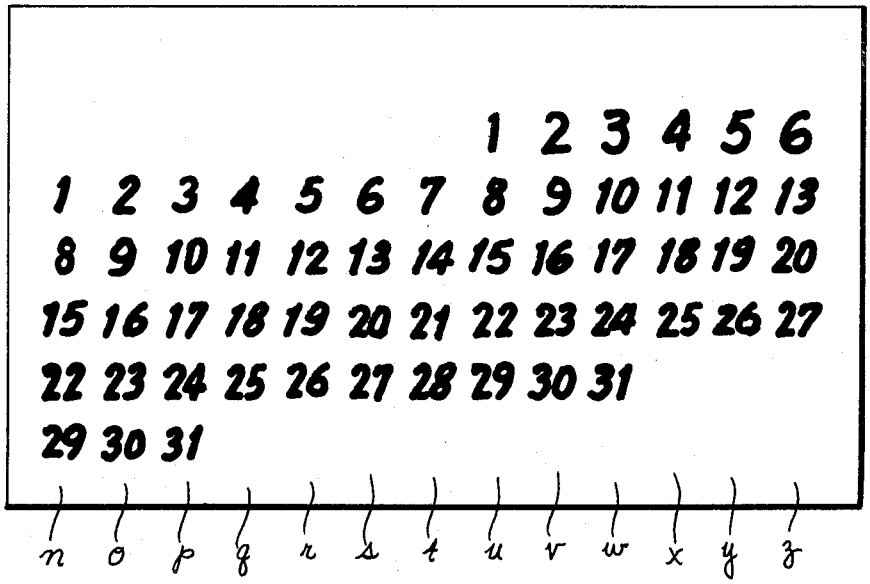
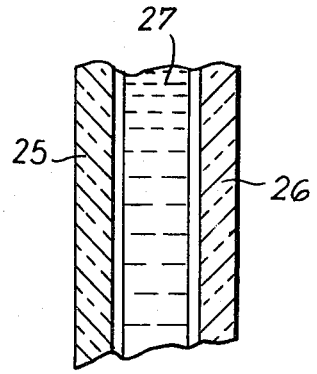
FIG. 6

FIG. 4
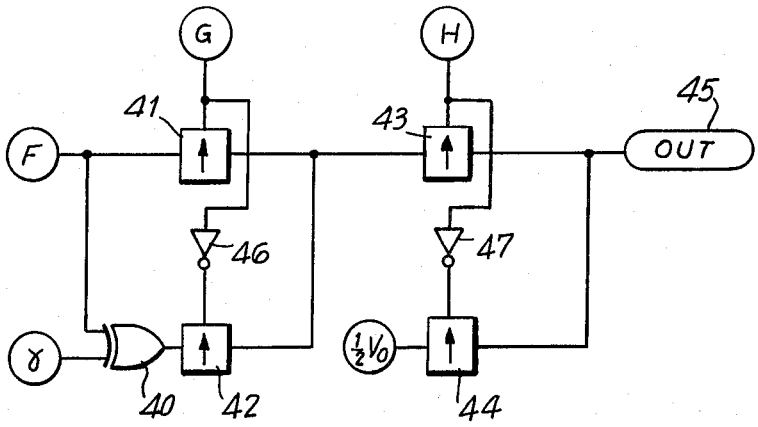
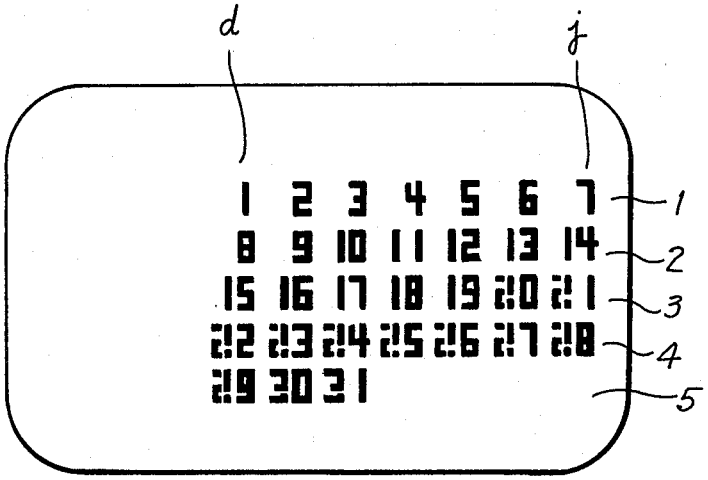
FIG. 5a

FIG. 5d
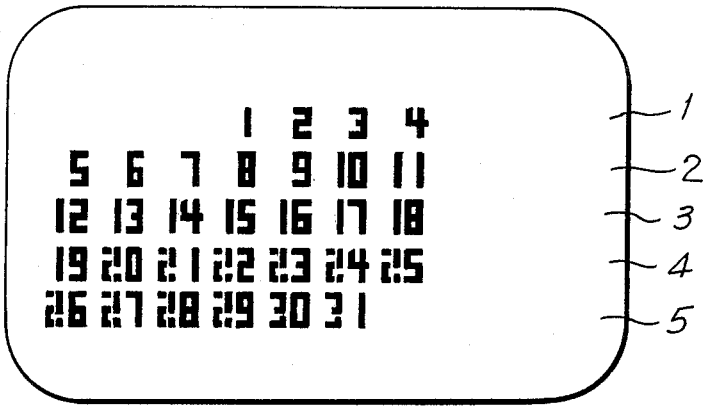
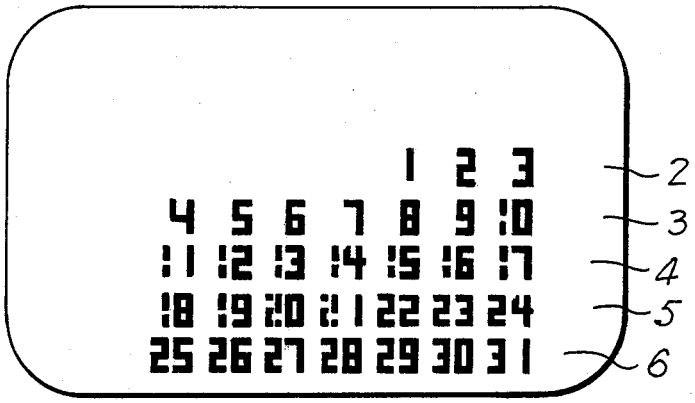
FIG. 5e

FIG. 5f
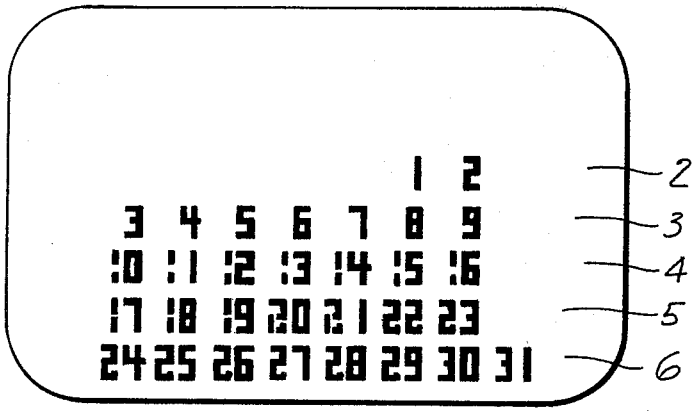
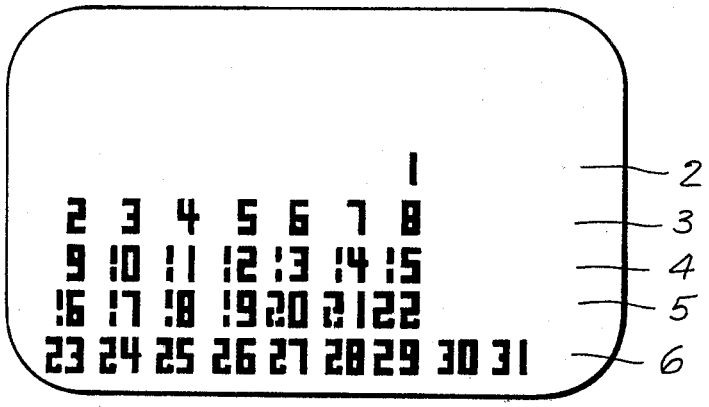
FIG. 5g

CALENDAR DISPLAY DEVICE

BACKGROUND OF THE INVENTION

This invention relates generally to an electronic calendar display device of the liquid crystal type and more particularly to a calendar display device where Sunday is always presented in the leftmost displayed column regardless of the calendar month and its starting day. A conventional electronic timepiece having a display used for displaying the calendar as a supplemental function has twenty-eight through thirty-one days located and displayed in fixed positions on the face of the timepiece. As indication of Sunday, for example, is displayed in an upper horizontal row, and the indication of Sunday is shifted laterally among the seven places representing the days of the week in a manner corresponding to the month being displayed. This embodiment is incorporated in the Seiko digital calendar watch Model M 354 produced by K. Hattori & Co., Ltd., Tokyo, Japan. In a normal printed calendar, Sunday is usually placed in the left column or occasionally, in Europe or America, in the right column. It is evident that a calendar may be more readily comprehended when Sunday is placed in the left column in a liquid crystal display. However, it is very difficult to display alternately seven date numerals in one date position on the calendar because it necessitates dividing the date display into many segments, and a great number of electrodes are necessary when it is considered that as many as thirty-one days need to be displayed. Therefore, as described above, the date numeral positions are fixed, and the day indication for Sunday is shifted laterally in the conventional calendar watch display of the prior art.

Another approach in the construction of a calendar display is shown in FIG. 1. The date numerals are visibly displayed in seven vertical columns even though the display panel has thirteen columns available. Thus, in any calendar week, there may be seven visibly displayed columns and a surplus of six columns of picture patterns which are not visibly displayed. When the number patterns of the left column n (FIG. 1) through the seventh column t from the left side are turned on, the display device shows a month in which the first day is on Sunday. During that month, the columns u–z are not turned on for display. When the number patterns of the second column o through the eighth column u from the left side are turned on, the display shows a month in which the first day is on Saturday. Columns n and v–z are not displayed. Similarly, when the number patterns of the seventh column t through the thirteenth column z are turned on, the display device shows a month in which the first day is on Monday. In this display construction, during each month, six columns of thirteen columns are entirely turned off, so that approximately half of the display face is blank. Thus, an unbalanced display configuration is presented, and the portion of the display panel driven for display in the current month is small and difficult to see and read.

What is needed is a calendar display device using liquid crystals which is simple in construction and displays each month in a large-sized format, with Sunday always appearing in the leftmost displayed column of the month.

SUMMARY OF THE INVENTION

Generally speaking, in accordance with the invention, a liquid crystal display device especially suitable for an electronic timepiece is provided. The display device presents a full month of dates in a large-sized format, with Sunday always located in the left column or always located in the right column of the display regardless of the day which is the first date in the presented month. Only 16 electrode patterns are used to form all dates, and months of twenty-eight to thirty-one days are accommodated. Display elements are driven by a V-2 V AC amplitude selective multiplexed system. A selectively divided pattern of electrodes permits selected positions of the display to present a choice of more than one numeral.

Accordingly, it is an object of this invention to provide an improved liquid crystal calendar device always displaying Sunday in the left-side column.

Another object of this invention is to provide an improved liquid crystal calendar device having a limited number of electrodes.

A further object of this invention is to provide an improved liquid crystal calendar display device wherein the number of electrodes is reduced by driving with a multiplexed amplitude selective signal.

Still another object of this invention is to provide an improved liquid crystal calendar display device which shows every month in a large-sized format.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is the pattern of numerals for a liquid crystal calendar display of the prior art;

FIG. 4 is an embodiment of a driving circuit suited for use with the electrode patterns of FIGS. 2(*a*) and (*b*);

FIG. 6 is a fragmentary view in cross section of a liquid crystal display element.

DESCRIPTION OF THE PREFERRED EMBODIMENTS

Figure 2A:
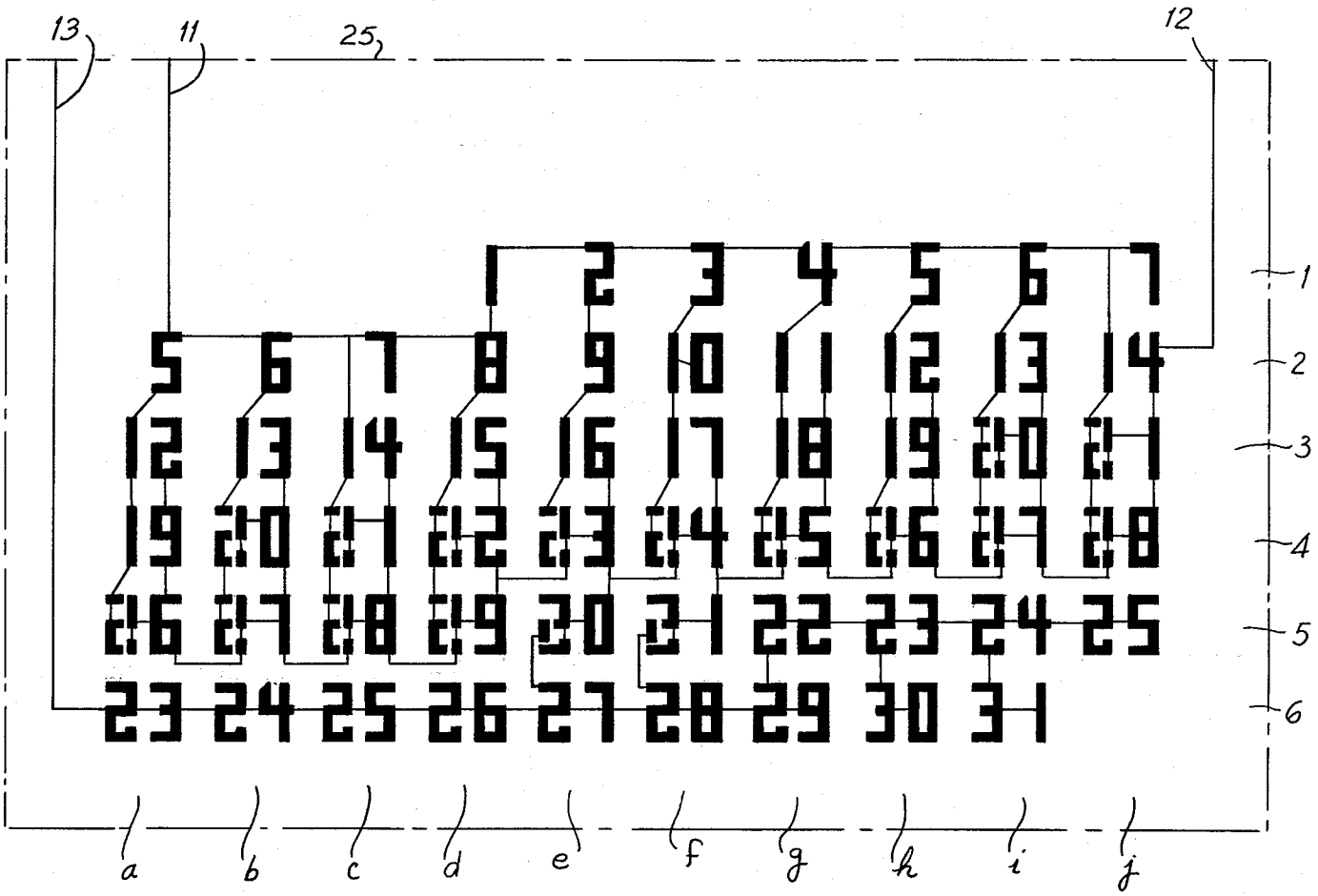
FIGS. 2(*a*) and (*b*) show the electrode patterns for a liquid crystal calendar display in accordance with this invention.
Figure 2B:
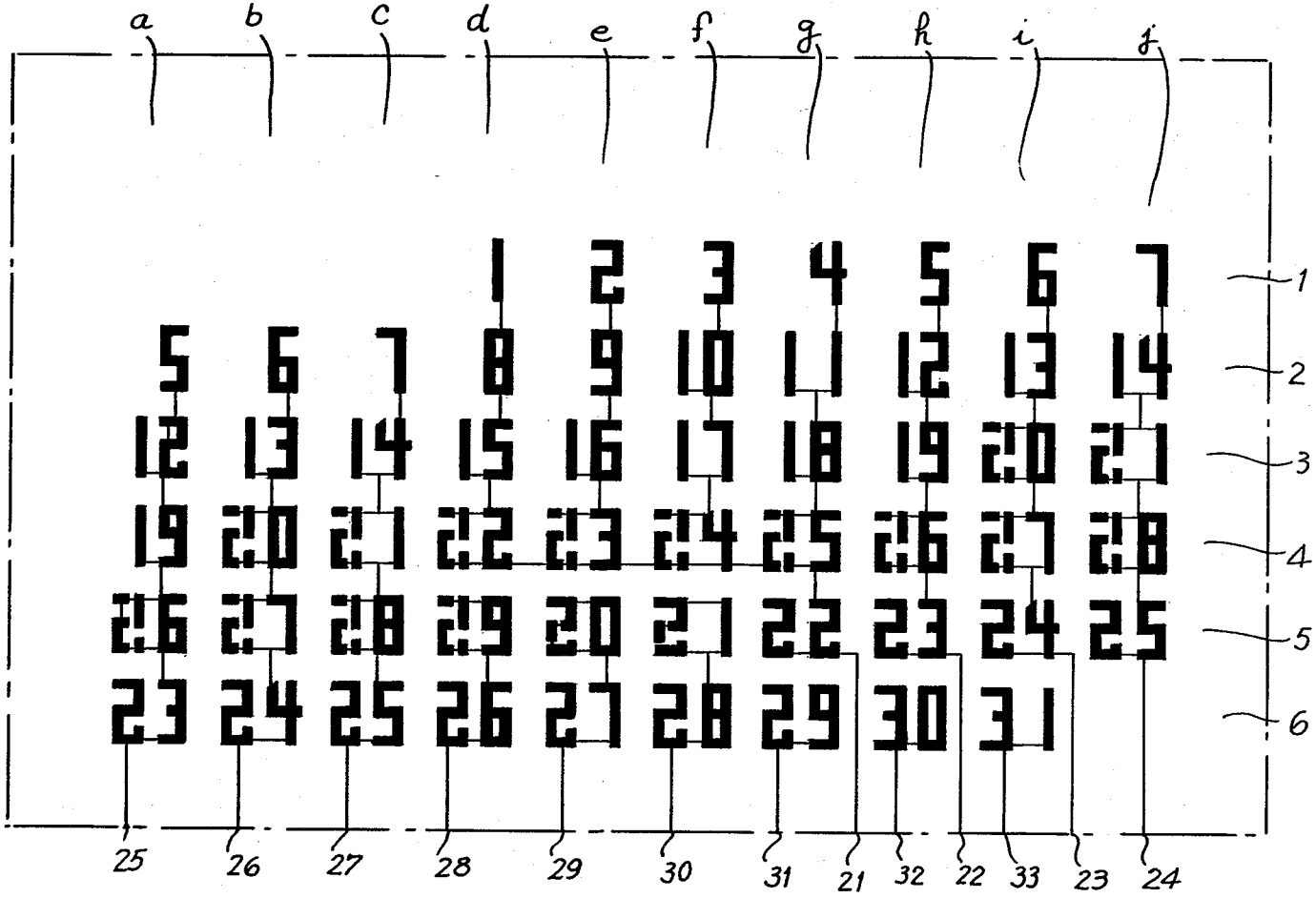

FIGS. 2(*a*) and (*b*) show electrode patterns for an embodiment of a liquid crystal display in accordance with this invention. The segments of the electrodes for forming picture patterns which can produce an illuminated display are presented by a heavy, thick line, and the portions which are not for display are represented by thin lines. In FIG. 2(*a*), the electrodes are formed on a transparent baseplate 25 and for convenience are called the common electrodes group. There are six horizontal rows and ten vertical columns. The electrode patterns shown in FIG. 2(*b*) are formed on another transparent baseplate 26 (FIG. 6) and are called for convenience the divided electrodes group. In order to display a calendar, that is, a pattern for a selected month, electrodes on the two plates 25, 26 are stacked in alignment, with a liquid crystal material 27 sandwiched therebetween in the known manner. Appropriate alternating-voltage waveforms are applied as explained more fully hereinafter.

In this embodiment, the display device is used for displaying the date numerals for a month. The overlapped electrode groups for display of dates are divided into ten columns a–j used for presenting the days of the week and into six vertical rows 1–6 which are used to indicate weeks. When driven, the overlapped electrodes are in condition to be displayed. Display depends upon the amplitude of the driving signal.

The upper overlapped electrode rows (FIGS. 2(*a*) and (*b*)) include seven consecutive numerals, 1 to 7, inclusive, starting at the fourth column d. The second overlapped electrode row includes ten consecutive numerals, 5 to 14, inclusive. The sixth row includes nine consecutive numerals, 23 to 31, inclusive. The third, fourth and fifth rows each include ten numerals; however, the electrode patterns at some positions are divided into small electrode segments such that more than one electrode segment is required to form a digit and more than one numeral can be formed at a given position on the display panel by selective driving of electrode segments.

As indicated in FIG. 2(*a*), the rows of the display are arbitrarily identified from the top as rows 1–6, and the columns are identified starting at the left side by the reference letters a through j. All digits in the first, second and sixth rows are formed of single electrodes, but a portion of the digits in rows 3, 4 and 5 is formed of a plurality of electrode segments in order that either of two digits may be selected for display in the same physical location on the panel. The divided electrode segments are used to form digits representing the tens order of a date numeral, that is, for example, the 2 in the date numeral 27. More particularly, in row 3, in the tens digit, the numeral 2 can be changed to the numeral 1 and vice versa. This construction applies in columns i and j. In row 4, there can be an interchange in displaying 2 or 1, depending upon the electrodes which are driven, and this construction is applied in every column excepting column a for the tens portion of the date numeral.

In the fifth row, certain tens digits can be either 3 or 2, and certain tens digits can be 2 or 1. This construction applies to rows a through i. Whether a digit is to appear as a 1, a 2 or a 3 depends on the month of the year which is displayed in calendar format and the day of the week which is the first date in the month. Sunday will always be displayed on the left side of the displayed portion. It should be noted that depending upon the month, either the row a, b, c or d is the left row, which represents Sunday.

Depending upon the month which is to be displayed, either rows 1 through 5 (case A) are used or rows 2 through 6 (case B) are used. Then, generally seven columns are selected from the ten available columns a–j to be driven to display a month. The ten columns are selected in correspondence with the first day of the month. Not every week in a calendar month has seven days. Therefore, in some months, less than seven columns are driven in the first and final weeks of a month. Also, in order to avoid the need for a seventh row of electrodes, that is, when the first day of a month is on Friday or Saturday (case B), the numerals appear in columns h and i, and the row 6 may have as many as nine dates presented, with the eighth date representing a Sunday and the ninth date representing a Monday where necessary. Where a seventh row is used, the units digit is divided so that either "30" or "31" is displayable in the left-side column.

Figure 5B:
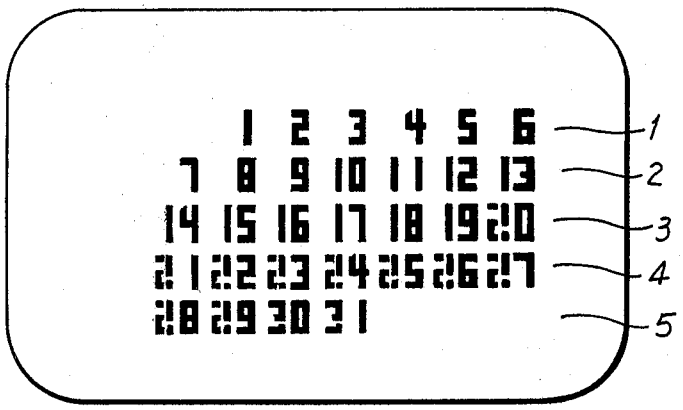
FIGS. 5(*a*) through (*g*) show seven calendar displays of months in accordance with this invention.
Figure 5C:
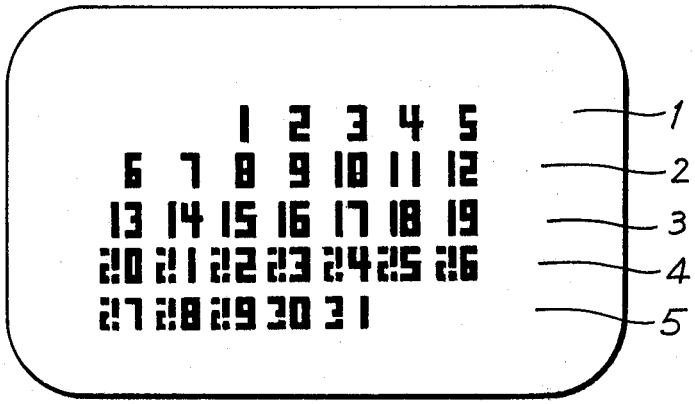

FIGS. 5(*a*) through (*g*) illustrate seven calendar configurations wherein the first date of the month falls on a different day and the left displayed column is Sunday. FIGS. 5(*a*) through (*d*) illustrate case A, utilizing rows 1 through 5, and FIGS. 5(*e*) through (*g*) illustrate case B, using rows 2 through 6. FIGS. 5(*f*) and (*g*) illustrate months starting on a Saturday or Sunday where the final row 6 displays more than seven dates to avoid a need for a seventh row of electrodes. The displayed months occupy a major portion of the display panel face area and are always substantially centered. Segmentation of tens digits is visible.

Figure 3:
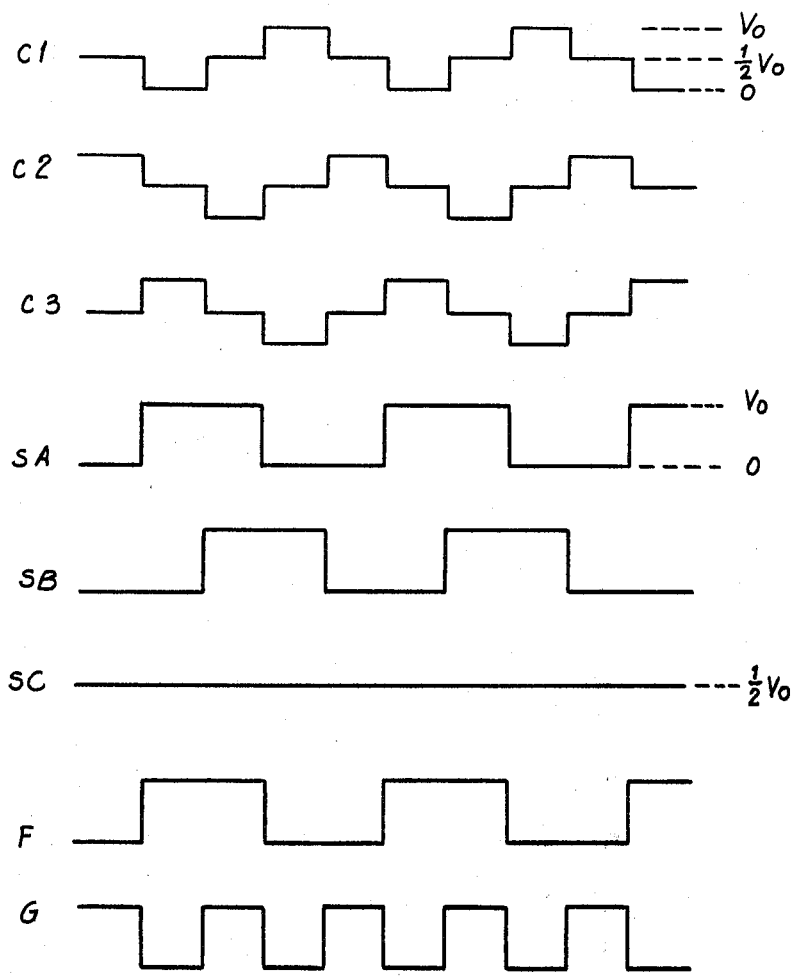
FIG. 3 shows multiplexed driving signals for use in association with the electrode patterns of FIGS. 2(*a*) and (*b*)

FIG. 3 shows fundamental driving waveforms for a liquid crystal display in accordance with this invention using three levels of voltage in a V-2 V AC amplitude selective multiplexing method. The three required voltage values for this method are zero (0), the full battery voltage of $V_0$ and a voltage which is one-half the battery voltage, namely, $\frac{1}{2}$ $V_0$, or zero, the full battery voltage $\frac{1}{2}$ $V_0$ and the double voltage, namely, $V_0$. In the known manner, driving signals are applied to electrodes on both baseplates 25, 26, and the magnitude of the differential voltage between the opposed and overlapped electrodes determines whether the overlapped electrodes are displayed, that is, turned on, or not displayed, that is, turned off. Because all of the driving signals for display are multiplexed, there is a duty cycle for the displayed overlapped electrodes; however, in spite of the duty cycle, the turned-on periods are of sufficient duration and repetition rate such that the display appears to the eye with constant intensity. In the display in accordance with this invention, the selected picture patterns of dates that are turned on are applied an effective voltage of $\sqrt{\frac{5}{8}}$ $V_0$. The unselected picture patterns that are turned off during the display of a particular calendar month are applied only an effective voltage of $\sqrt{\frac{1}{8}}$ $V_0$.

This display will have its greatest utility when it is embodied in a quartz crystal timepiece whereby synchronization of the monthly calendar changes to the hour and the date is readily achieved. When the calendar display is used independently of a timepiece, other means, usually external, are required to change the display from month to month.

The stepped driving signals, C1, C2 and C3 can be provided by conventional methods warranting no further description herein. The signals SA, SB and SC are produced by the circuit of FIG. 4, as explained more fully hereinafter. Signals F and G are reference signals derived from the divider circuit of the timepiece. For the month using the upper row 1 (case A), picture patterns for display are produced by electrodes on the baseplate 26 which are overlapped by the common electrodes 11, 12 of baseplate 25. For months falling into case B, using the lower row 6 of the display, the picture patterns for display are produced by the divided electrodes on baseplate 26 which are overlapped by the common electrodes 12, 13 of the baseplate 25. In either case A or B, the signal C1 is applied to the common electrode 11, the signal C2 is applied to the common electrode 12 and the signal C3 is applied to the common electrode 13. Then, the columns for display, usually seven in number, are selected, choosing the left side column for display in accordance with the number of days included in the particular month and in accordance with the day which is the first date of that particular month. For a month falling into the category A, the driving signal SA is applied to the divided electrodes in each selected column. Simultaneously, the signal SC is applied to the divided electrodes in all unselected columns. For the months of the year falling into the category B, the driving signal SB is applied to divided electrodes in all selected columns. Again, the signal SC is applied to the divided electrodes in all the unselected columns. The displayed left-side column is Sunday.

To be effective, the circuits generating the driving signals for the divided electrodes must take into account which day of the week is the first date of the month to be displayed and whether the month has twenty-eight, twenty-nine, thirty or thirty-one days. It should be apparent to those skilled in the art that many codes can be prepared to accommodate the required conditions. Herein is presented, as an example, such a code. In accordance with Table 1, the bits $\alpha$, $\beta$ and $\gamma$ indicate which day (Sun., Mon., Tues. . . . ) of the week is the first date of the month. This code for each day of the week is easily achieved using a counter operating on the timekeeping signals of the timepiece. The bits $\delta$ and $\epsilon$ for discriminating the months having twenty-eight, twenty-nine, thirty or thiry-one days are changed in accordance with the number of days in the month, as shown in Table 2.

TABLE 1

| First Day of Month | Data Bits — Day of the Week | | | | | | | |
|---|---|---|---|---|---|---|---|---|
| | Sun. | Mon. | Tues. | Wed. | * | Thur. | Fri. | Sat. |
| bit $\alpha$ | 0 | 1 | 0 | 1 | 0 | 1 | 0 | 1 |
| bit $\beta$ | 0 | 0 | 1 | 1 | 0 | 0 | 1 | 1 |
| bit $\gamma$ | 0 | 0 | 0 | 0 | 1 | 1 | 1 | 1 |

TABLE 2

| Number of Days in Month | Data Bits — Number of Days in Month | | | |
|---|---|---|---|---|
| | 28 | 29 | 30 | 31 |
| bit $\delta$ | 0 | 1 | 0 | 1 |
| bit $\epsilon$ | 0 | 0 | 1 | 1 |

The combination of bits 001 indicated with an asterisk (*) in Table 1 is not used in the driving circuits. Also, it should be noted that the bit $\gamma$ in Table 1 is low, that is, 0, in case A where the month starts on a Sunday, Monday, Tuesday or Wednesday, and the bit $\gamma$ is high, that is, 1, in case B where the month starts on Thursday, Friday or Saturday. Therefore, the data bits $\gamma$ is used in all the driving circuits to determine whether the selected divided electrodes on the baseplate 26 are to be driven by the signal SA or SB.

FIG. 4 is a circuit for producing the driving signals which are to be applied to the divided electrodes 22–23 on the baseplate 26. Each electrode is driven by a similar circuit. The output signal 45 is delivered from either a gate 43 or a gate 44, depending upon the state of the input H. As explained hereinafter, the signal H determines whether the associated divided electrodes are to be driven for display or are to be driven at such a low voltage as not to be displayed. A high signal H opens the gate 43 to the output 45 and simultaneously, by means of an inverter 47, closes the gate 44. A low signal H closes the gate 43 and, by means of the inverter 47, opens the gate 44 to apply a weak signal of $\frac{1}{2}$ $V_0$ to the output 45. Accordingly, a high signal H drives the associated divided electrode for display, and a low signal H turns off the associated divided electrode. The square wave reference signal G (FIG. 3) is applied directly to a gate 41 and invertedly, via an inverter 46, to gate 42. Accordingly, gates 41 and 42 are alternately open and closed, with a high signal G opening gate 41 and closing gate 42. When the gate 41 is open, portions of the reference signal F pass through the gate 41 and are applied to the inlet of the gate 43. To the input terminal of the gate 42 is applied the output of an exclusive OR gate 40. The condition of the data bit $\gamma$ is applied to one terminal of the OR gate 40, and the reference signal F is applied to the other input terminal of the OR gate 40. Accordingly, dependent upon the state 1 or 0 of the data bit $\gamma$, different portions of the reference signal F pass through the gate 42 when the gate 42 is open and are presented as inputs to gate 43. Accordingly, when the data bit $\gamma$ is zero, that is, case A, and the selecting signal H is high, the output 45 will have the waveform SA. When the data bit $\gamma$ is one, that is, case B, and the selecting signal H is high, the output signal 45 will have the waveform SB. As stated above, when the selecting signal H is low, the output 45 is insufficient in voltage level to cause display of the associated divided electrode.

Therefore, the circuit for each divided electrode 21–33 must be inputted the proper H signal in accordance with the Tables 1 and 2 such that the associated electrode is driven for display or is in a turned-off condition. More particularly, using the code presented in Tables 1 and 2, a signal for selecting a divided electrode for display or nondisplay can be expressed by a logical equation using the data bits as follows. The divided electrode 22 is selected for display except when the first day of the month falls on a Wednesday (FIG. 5(*d*)) or Saturday (FIG. 5(*g*)), and the signal H is expressed, as $\overline{\alpha}+\overline{\beta}$. Similarly, the electrode 23 has $\overline{\beta}$ as the selecting signal H. The selecting signal for the divided electrode 24 is $\overline{\alpha}\cdot\overline{\beta}$. The selecting signal for electrode 25 is $\alpha\cdot\beta$. The selecting signal for electrode 26 is $\beta$. The selecting signal for electrode 27 is $\alpha+\beta$. The selecting signal for the electrode 28 is $\epsilon+\delta+\gamma$. The selecting signal for the electrode 29 is $\epsilon+\gamma$. The selecting signal for the electrode 30 is $\epsilon\delta+\gamma$. The selecting signal for the electrode 31 is $\epsilon+\delta$. The selecting signal for the electrode 32 is $\epsilon$. The selecting signal for the electrode 33 is $\epsilon\cdot\delta$, and the divided electrode 21 is always selected for display in every month, so that the selecting bit H is always maintained at the level 1. With the signals applied at the selecting terminal H of FIG. 4 in accordance with the exemplary code presented above, the common and divided electrodes are driven so as to provide the seven displays of the year 5(*a*) to (*g*).

Figure 7:
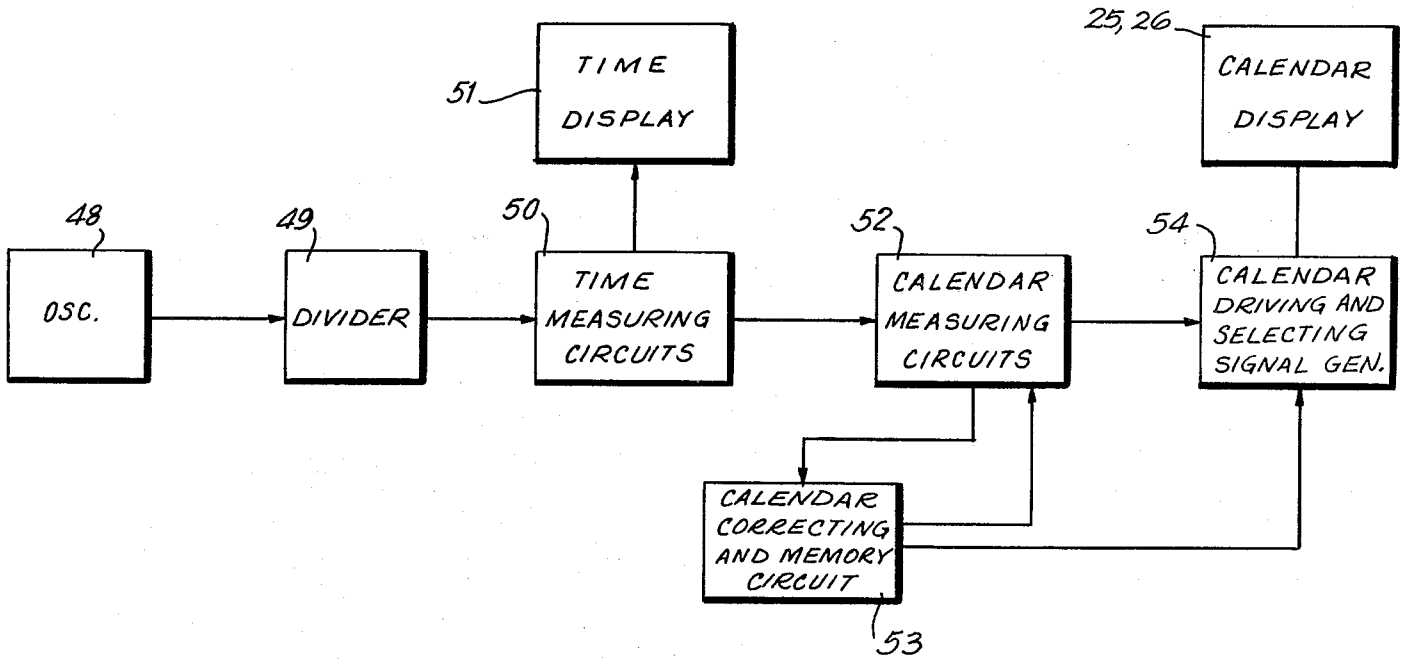
FIG. 7 is a timepiece with a calendar display in accordance with this invention.

FIG. 7 shows an electronic timepiece using a calendar display in accordance with this invention. The timekeeping portion is comprised of a high-frequency standard oscillator 48 inputting signals to a divider 49 which outputs lower-frequency timekeeping signals. Time-measuring circuits 50 accumulate the timekeeping signals into units of time, e.g., hours, minutes, which are used to drive the time display 51 in the known manner.

Carryover signals from the time-measuring circuits 50 are input to calendar-measuring circuits 52. Data representative of the number of days in a particular month are stored in a calendar memory circuit 53 and compared with the days accumulated by the calendar-measuring circuits 52. At the end of the last day of the month, a signal from the calendar-measuring circuits 52 advances the memory 53 to output data of the next month. These data from memory and reference signals FG from the calendar-measuring circuits 52 are fed to the selecting and driving circuits 54 for driving the display as described above.

As is evident from the FIGS. 5(*a–g*), the calendars are somewhat shifted from month to month, but Sunday is always displayed in the left column, the calendar covers the major portion of the display area, the calendar is easily read and comprehended, and the display device in accordance with this invention has great utility, especially when used in conjunction with a timepiece.

It should be readily apparent that in an alternative embodiment of this invention Monday can be displayed in the left column of any displayed month as is frequently done in fiscal calendars. In fact, any selected day can have a preferred position with the same efficiency in the use of electrodes and display panel face area as described above.

It will thus be seen that the objects set forth above, and those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a calendar display device including first and second spaced and opposed electrode patterns having overlapped portions, and a liquid crystal material sandwiched between said electrode patterns, the improvement there comprising:

the overlapped portions of said opposed electrode patterns forming six rows and ten columns of numerals, said numerals being consecutive in each said row, so much of said electrode patterns defining a unit or ones digit of each numeral being respectively commonly driven, a portion of the numerals having two digits having a tens digit formed of a plurality of electrodes for display, said plurality of electrodes being adapted for driving in at least two groups, selection among said groups causing said tens digit to be selectively displayed as one of at least two numerals;

circuit means for selecting and driving said electrodes for display or non-display, said circuit means being adapted to select either the upper five rows or lower five rows of said six rows for driving, and to select consecutive columns for driving to display calendar months, the left-side column of the displayed month being a selected day of the week regardless of which calendar month is displayed.

2. A calendar display device as claimed in claim 1, wherein the first numeral of the first row is a 1 located in the fourth column from the left side of said pattern of rows and columns, the remaining rows having the first numeral in the first column, and the first three numerals of said remaining rows repeat the final three numerals of the next preceding row.

3. A calendar display device as claimed in claim 1, wherein a portion of said tens digits formed of a plurality of electrodes is selectively driven in said groups to display either a 1 or 2, and another portion of said tens digits is selectively driven in said groups to display either a 2 or 3, and another portion of said tens digits is selectively driven in said groups to display a 1 or be turned off.

4. A calendar display device as claimed in claim 1, wherein the number of electrodes in said first pattern of electrodes is thirteen, and the number of electrodes in said second pattern of electrodes is three.

5. A calendar display device as claimed in claim 2, wherein said circuit means is adapted to select and drive electrodes for display in accordance with the number of days in the month, and further comprising memory means for inputting data to said circuit means, said data being representative of the number of days in the displayed month.

6. A calendar display device as claimed in claim 2, wherein said electrodes are driven by multiplexed voltage driving signals from said circuit means.

7. A calendar display device as claimed in claim 6, wherein the number of voltage levels in said multiplexed voltage driving signals is three.

8. A calendar display device as claimed in claim 2, wherein said display cooperates with an electronic timepiece, said driving signals from said circuit means being synchronized by reference timing signals from said timepiece, whereby the calendar display is timely changed.

9. A calendar display device as claimed in claim 4 or 6, wherein a portion of the tens digits of numerals of two digits is formed of a plurality of electrodes, a portion of said tens digits being selectively driven to display either a 1 or 2, another portion of said tens digits being selectively driven to display either a 2 or 3, and another portion of said tens digits is selectively driven to display a 1 or be turned off.

10. A calendar display device as claim 5, wherein said memory means also retains data representative of the day of the week of the first day of the month.

11. A calendar display device as claimed in claim 10, wherein said day of the week is stored in a three bit format, a different three bit code being stored for each day of the week.

12. A calendar display device as claimed in claim 11, wherein said memory means stores data in a two bit format, a different two bit code being indicative of the number of days in a month from 28 through 31 days.

13. A calendar display device as claimed in claim 12, wherein one bit of said day of the week data for each day is sensed by said circuit means, the binary state of said one bit determining whether the upper five rows or the lower five rows are used for the display of a calendar month.

14. A calendar display device including a pair of opposed baseplates and a liquid crystal material sandwiched between said baseplates, each said baseplate having a plurality of electrodes formed in a pattern thereon, said pattern comprising electrode segments for display arranged to define six rows and ten columns; electrode segments in a first said row forming consecutive numerals of one digit; electrode segments in a second said row forming consecutive numerals of one and two digits; electrode segments of a sixth row forming consecutive numerals of two digits; electrode segments in a third, fourth and fifth row being positioned to form two-digit numerals, with the ones digit being in consecutive order, the segment patterns of the last three numerals of each row being repeated as the segment patterns of the first three numerals of the following rows of said six rows, at least a portion of the tens digits in said third, fourth and fifth rows being formed by segments of at least two of said plurality of electrodes, whereby a portion of the tens digits in said third, fourth and fifth rows is selectively displayable in a plurality of numerical values, circuit means for selecting and driving said electrodes for display or non-display, said circuit means being adapted to select either the upper five rows or lower five rows of said six rows for driving, and to select consecutive columns for driving to display calendar months, the left-side column of the displayed month being a selected day of the week regardless of which calendar month is displayed.

15. A calendar display device as claimed in claim 14, wherein the number of said electrodes on the first said baseplate is three.

16. A calendar display device as claimed in claim 14 or 15, wherein the number of said electrodes on the second said baseplate is thirteen.

17. A calendar display device as claimed in claim 15, wherein the numeral "1" is in the first row at the fourth column.

18. A calendar display device as claimed in claim 14, wherein one of said electrodes includes segments in five of said six rows.

19. A calendar display device as claimed in claim 14, wherein said plurality of numerical values in said third row includes 1 and 2, in said fourth row includes 1 and 2, and in said fifth row includes 1, 2 and 3.

20. A calendar display device as claimed in claim 16, wherein the numeral "1" is in the first row at the fourth column.

* * * * *